US005174090A

United States Patent [19]

Teli et al.

[11] Patent Number: 5,174,090

[45] Date of Patent: Dec. 29, 1992

[54] GRID CEILING

[75] Inventors: Jonathan P. Teli; John J. Heichberger, both of Marrietta, Ga.

[73] Assignee: Hunter Douglas Architectural Products Inc., Duluth, Ga.

[21] Appl. No.: 574,676

[22] Filed: Aug. 30, 1990

[51] Int. Cl.[5] ..... E04B 9/36; E04C 2/42

[52] U.S. Cl. ..... 52/488; 52/666; 52/668

[58] Field of Search ..... 52/488, 664, 666, 667, 52/668, 669

[56] References Cited

U.S. PATENT DOCUMENTS

| | | | |
|---|---|---|---|
| 2,710,679 | 6/1955 | Bibb et al. . | |
| 3,003,055 | 10/1961 | Liberman | 52/668 |
| 3,777,432 | 12/1973 | Wyles . | |
| 4,625,470 | 12/1986 | Heritage | 52/667 |
| 4,658,562 | 4/1987 | Brugman | 52/665 |
| 4,665,674 | 5/1987 | Brugman | 52/488 |
| 4,738,066 | 4/1988 | Reed | 52/664 |
| 4,951,443 | 8/1990 | Caferro . | |

FOREIGN PATENT DOCUMENTS

| | | |
|---|---|---|
| 210385 | 2/1987 | European Pat. Off. . |
| 2523625 | 9/1983 | France . |
| 2122666 | 1/1984 | United Kingdom . |

*Primary Examiner*—Michael Safavi

*Attorney, Agent, or Firm*—Jacobson, Price Holman & Stern

[57] ABSTRACT

A grid ceiling comprising the support grid 10, 12 having first openings 16 therein in at least some of which are mounted first grid elements 24 defining second openings 30 in which second grid elements 40 are mounted. In this way several grid elements of progressively smaller size can be mounted in openings in preceeding grid elements, e.g. to provide a pyramidal structure.

7 Claims, 1 Drawing Sheet

GRID CEILING

Figure 1:
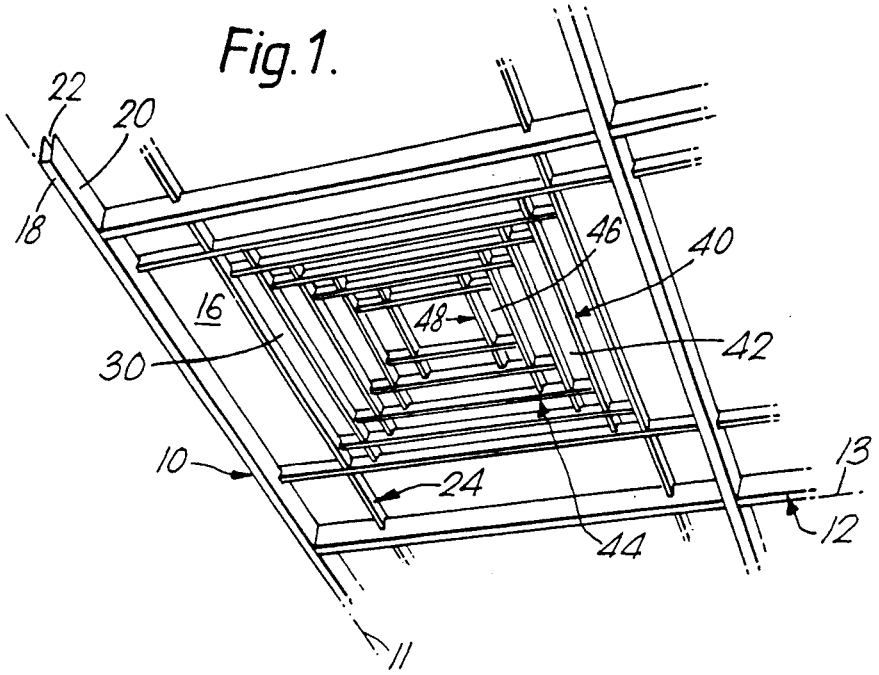

The present invention relates to grid ceilings. Many different forms of grid ceilings have been proposed, these usually being designed to cover up services such as water and gas feed pipes, electric wiring, air conditioning and the like. For example U.S. Pat. Nos. 4,658,562 and 4,665,674 show one particular form of ceiling, in which a main grid is provided and into each of the rectangular openings in this grid is fitted a grid panel. A somewhat different structure is shown in U.S. Pat. No. 4,625,470 in which each grid panel is, in effect, formed by two T-shaped members, the stem and the arms of which are hinged to one other. These grid ceilings are generally satisfactory, but give a rather limited visual effect. It is an object of the present invention to provide the facility for giving a greater variety of visual effect.

It is now proposed, according to the present invention, for the grid ceiling to comprise of plurality of elongate first support members, said first support members having parallel longitudinal axes; a plurality of elongate second support members, said second support members having parallel longitudinal axes angled with respect to the longitudinal axes of the first support members, effective to define therewith a grid with polygonal first openings therein; a first grid element inserted in at least one of said first openings, said first grid element defining therein at least one second opening and a second, smaller grid element inserted in said at least one opening of said first grid element.

With such a structure one can readily modify the format of the second smaller grid element which can be inserted in all or in some of the second openings in a variety of different arrangements to give a totally different visual effect.

Preferably the first grid element comprises a plurality of first elongate members angled with respect to one another effective to define said at least one second opening, whereby said at least one second opening is of polygonal shape. The second grid element may comprise a plurality of second elongate grid members angled with respect to one another, the second grid members being shorter in length than the relevant parallelly extending first grid members. In this way one can have progressively smaller grid elements.

Desirably the first grid members are mounted at a level different from the level of the first and second support members and alternative or additional, the second grid members are mounted at a level different from the first and second support members.

Advantageously a third opening is defined in the, or each second grid element and a third grid element is mounted in the third opening. Additional grid elements can continue to be mounted in this way. If the grid elements are mounted at different levels, as suggested above, one can produce, in effect, a pyramidal shape in each opening in the support members.

Figure 2:
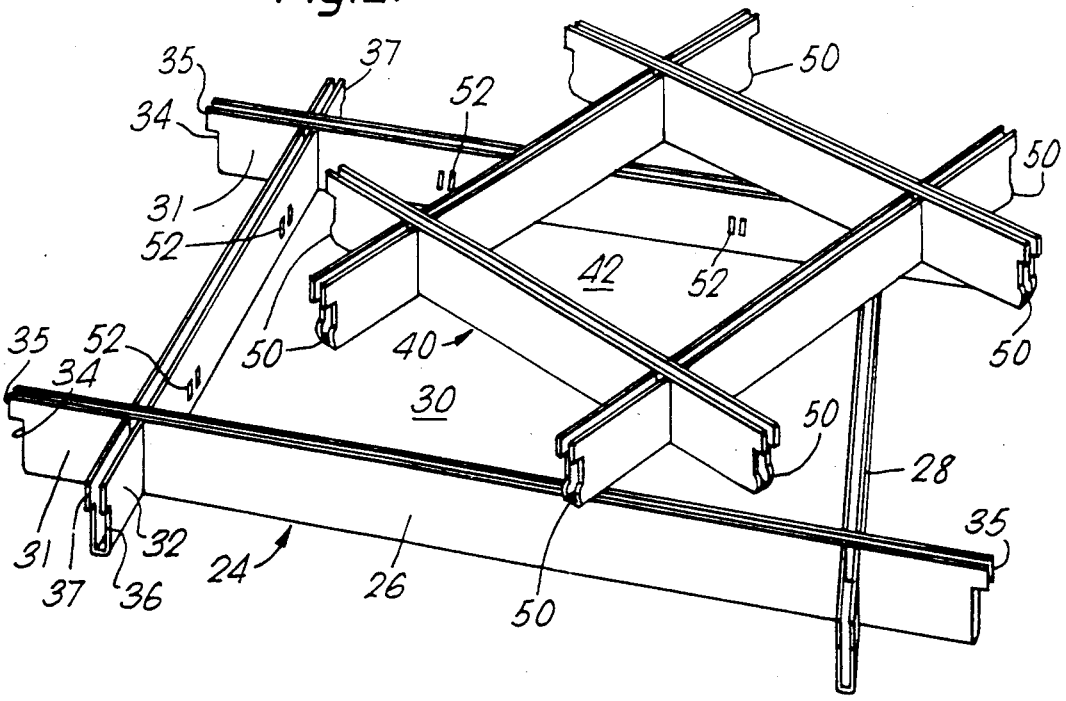

In order that the present invention may more readily be understood, the following description is given, merely by way of example, reference being made to accompanying drawings in which;

FIG. 1 is a perspective view showing a portion of one embodiment of grid ceiling according to the invention; and FIG. 2 shows, in perspective, first and second grid elements of the ceiling of FIG. 1, prior to being assembled.

Referring first to FIG. 1, there is illustrated therein a presently preferred embodiment of grid ceiling according to the invention. This comprises a support grid comprising a plurality of elongate first support members 10, having longitudinal parallel axes 11 and a variety of elongate second support members 12, the second support members having parallel longitudinal axes 13 angled in the embodiment illustrated at right angles to the axes 11 effective to define therewith the grid with polygonal in this instance, rectangular first openings 16 therein.

The support members 10,12 in this construction are each in the form of U-profiled sheet metal members having a lower web 18, side flanges 20 these having inturned rims 22 at their upper edges.

Mounted within some, or all, of the openings 16 are first grid elements 24 which are each formed of a plurality of first elongate grid members 26 (FIG. 2) and second elongate grid members 28, defining a central second opening 30. The grid members 26,28 are again each of U-profiled sheet metal, similar to the support members 10,12 and they may be formed of the same cross section material or, as shown, of smaller cross section material. The grid members 26 each have intermediate their ends cutouts extending upwardly from the web portion of the grid member 26 to about half the height of the grid member 26 while the second grid members 28 have similar, complementary cutouts whereby the members 26,28 can be interfitted, as shown in the drawings, to define end portions 31,32 which are notched at 34,36. The distance between the ends of the grid members 26, defined by the notches 34 at the ends thereof, is chosen to be a close fit between the side walls or flanges 20 of the support members 12 so that the unnotched portions 35 thereof rest on the rims 22 and prevent the grid moving in that direction.

Similarly the lengths of the grid members 28 between the notched portions 36, at the ends thereof, is adapted to the spacing between the support members 10 so that the unnotched portions 37 of grid members 28 rests on the rims of the support members 10.

In a similar way, second grid elements 40, are identical, but of smaller dimensions, are mounted in the openings 30 and define a third opening 42 in which a third grid element 44, again of identical but smaller construction is mounted. This again defines a further central opening 46 in which a further grid element 48 is mounted.

In the embodiment shown, because of the provision of the notches 36 in each of the grid members, this notch extending approximately ⅔rds of the way up the length of the associated grid member, each grid element is mounted higher than the support grid, the second grid element is mounted higher than the first grid element and so on. In this way a generally pyramidal structure can be provided.

For internal use, the grid elements may simply be retained in place by gravity. For external use, where the assembly may be subjected to winds and other environmental problems, it may be advantageous for the grid elements to have means positively to retain them in place and for this reason there is illustrated in FIG. 2 a rounded protrusion 50 on the end of each notched end portion 34,36 and this being adapted to be engaged in a corresponding opening in the adjacent support member 10,12. Second and subsequent grid elements may be retained by similar protrusions engaging in similar corresponding openings 52 of a surrounding grid element.

We claim:

1. A grid ceiling comprising, in combination:

a) a plurality of elongate first support members, said first support members having parallel longitudinal axes;

b) a plurality of elongate second support members, said second support members having parallel longitudinal axes perpendicular to the longitudinal axes of the first support members, thereby defining a grid with rectangular first openings therein;

c) a plurality of first grid elements inserted in each of said first openings, each said first grid element being defined by four first grid members disposed in a rectangular frame to define a rectangular second opening therein smaller than said first openings, the first grid elements being supported on said grid and extending to a level above the grid; and d) a plurality of second, smaller grid elements, each said second grid element being inserted in the rectangular second opening of a respective one of said first grid elements each said second grid elements being defined by four second grid members disposed in a rectangular frame to define a rectangular third opening therein smaller than said second openings, the second grid elements being supported on the first grid elements and extending to a level above the first grid elements.

2. A grid ceiling as claimed in claim 1, further comprising a plurality of rectangular frame shaped third grid elements smaller than the second grid elements and each defining therein a fourth rectangular opening for a subsequent smaller grid element the third grid elements being supported on the second grid elements and extending to a level above the second grid elements.

3. A grid ceiling comprising, in combination:

a plurality of elongate first support members, said first support members having parallel longitudinal axes;

a plurality of elongate second support members, said second support members having parallel longitudinal axes angled with respect to the longitudinal axes of the first support members, thereby defining a grid with a plurality of polygonal first openings defined by said first support members and said second support members;

at least one first grid element comprising a plurality of first elongate grid members angled with respect to one another thereby defining a polygonal second opening defined by said first elongate grid members, said at least one first grid element being supported by said grid within one of said polygonal first openings the first grid element extending to a level above the grid; and at least one second grid element comprising a plurality of second elongate grid members angled with respect to one another thereby defining a polygonal third opening defined by said second elongate grid members, said second elongate grid members being shorter in length than corresponding, parallelly extending first grid members such that said second grid element is smaller than said first grid element, said at least one second grid element being supported by the first grid element within said polygonal second opening of said at least one first grid element, the second grid element extending to a level above the first grid element.

4. A grid ceiling as claimed in claim 3, comprising a plurality of said first grid elements and a plurality of said second grid elements, wherein each of said first grid elements i positioned within a respective one of said polygonal first openings and each of said second grid elements is positioned within a respective on of said polygonal second openings of said first grid elements.

5. A grid ceiling as claimed in claim 3, wherein said second support members are arranged perpendicular to said parallel first support members whereby said first openings are substantially rectangular.

6. A grid ceiling as claimed in claim 3, wherein said first grid members are arranged perpendicular to one another, whereby said polygonal second opening is substantially rectangular.

7. A grid ceiling as claimed in claim 3, wherein said second grid members are arranged substantially perpendicular to each other.

* * * * *

UNITED STATES PATENT AND TRADEMARK OFFICE

CERTIFICATE OF CORRECTION

PATENT NO. : 5,174,090

DATED : December 29, 1992

INVENTOR(S) : JONATHAN P. TELI; JOHN J. HEICHBERGER, both of Marrietta, Georgia

It is certified that error appears in the above—identified patent and that said Letters Patent is hereby corrected as shown below:

Column 3, line 24: "--elements--" should read -- element --

Column 4, line 29: "--elements i--" should read -- elements is --

Column 4, line 31: "--on of--" should read -- one of --

Signed and Sealed this

Twenty-first Day of December, 1993

Bruce Lehman

*Attest:*

BRUCE LEHMAN

*Attesting Officer*

*Commissioner of Patents and Trademarks*